US006775845B2

(12) United States Patent
Eghamn

(10) Patent No.: US 6,775,845 B2
(45) Date of Patent: Aug. 17, 2004

(54) JOINT DEVICE FOR A LEG GUARD

(75) Inventor: Lars Eghamn, Rättvik (SE)

(73) Assignee: Sportopedgruppen AB, Rattvik (SE)

( * ) Notice: Subject to any disclaimer, the term of this patent is extended or adjusted under 35 U.S.C. 154(b) by 0 days.

(21) Appl. No.: 10/469,694

(22) PCT Filed: Mar. 18, 2002

(86) PCT No.: PCT/SE02/00506

§ 371 (c)(1),
(2), (4) Date: Sep. 11, 2003

(87) PCT Pub. No.: WO02/076559

PCT Pub. Date: Oct. 3, 2002

(65) Prior Publication Data

US 2004/0078861 A1 Apr. 29, 2004

(30) Foreign Application Priority Data

Mar. 22, 2001 (SE) ..... 0100999

(51) Int. Cl.[7] ..... A41D 13/00
(52) U.S. Cl. ..... 2/22; 602/16
(58) Field of Search ..... 2/22, 24, 62, 455, 2/2.12, 911; 128/881, 882, 877; 602/16, 23, 25, 26, 62

(56) References Cited

U.S. PATENT DOCUMENTS

| | | | | |
|---|---|---|---|---|
| 3,779,654 A | * | 12/1973 | Horne | 403/62 |
| 4,068,312 A | | 1/1978 | Ledesma | 2/24 |
| 4,333,181 A | | 6/1982 | Corriero | 2/24 |
| 4,409,689 A | | 10/1983 | Buring et al. | 2/22 |
| 4,490,855 A | | 1/1985 | Figgie, III et al. | 2/24 |
| 4,890,607 A | * | 1/1990 | Townsend | 602/26 |
| 5,107,823 A | * | 4/1992 | Fratesi | 602/16 |
| 5,172,425 A | | 12/1992 | Smith | 2/22 |
| 5,561,857 A | * | 10/1996 | Hoshizaki et al. | 2/22 |
| 5,652,956 A | * | 8/1997 | Hoshizaki et al. | 2/22 |
| 5,662,594 A | * | 9/1997 | Rosenblatt | 602/16 |
| 5,732,411 A | | 3/1998 | Coleman et al. | 2/22 |

FOREIGN PATENT DOCUMENTS

| | | |
|---|---|---|
| CA | 2084329 | 7/1996 |
| SE | 8103133-8 | 1/1983 |

* cited by examiner

*Primary Examiner*—Tejash Patel
(74) *Attorney, Agent, or Firm*—Jacobson Holman PLLC

(57) ABSTRACT

A joint device for a leg guard, particularly for a leg guard used by ice-hockey players, comprises a first part that covers the wearer's lower leg, and a second part (2) that covers a part of the wearer's thigh above the knee and that is pivotally connected to the first part (1) via a joint element (4). A cup-shaped third part (3) bridges the gap between the first and the second parts (1, 2) and is pivotally mounted (5) on the second part (2). The joint element (4) includes pins which engage in a slot or groove (11) on the sides of the third part (3), so that the third part (3) will be dogged by the second part (2) when the angle between the first and the second parts is smaller than a limit angle. The first part (1) includes pins (8) which engage in a second slot (10) in the third part (3). The second slots include a first circular section whose center lies in the first joint element (4) when the guard is at a more pronounced angle than the limit angle. The second slot (10) has a second section (10*b*) that extends form the lower end of the first section (10*a*) in a direction radially away from the second joint elements. When the first and the second parts (1, 2) define an angle that is smaller than the limit angle, the third part (3) and the portions (21, 32) of respective first and second parts overlapped by said third part (3) have generally the same radius of curvature and common centre of curvature in the first joint element (4).

3 Claims, 2 Drawing Sheets

JOINT DEVICE FOR A LEG GUARD

This is a nationalization of PCT/SE02/00506 filed Mar. 18, 2002 and published in English.

The present invention relates to a joint device for a leg guard of the kind defined in the preamble of claim 1.

A joint device of this kind is known from SE-B-8103133-8.

It should be possible for a leg guard intended for use by sportsmen/sportswomen, for instance ice-hockey players, to bend from a generally straight state when the legs of the wearer are straight to a state in which the first part of the leg guard covering the wearer's shins is bent to an angle of <90° with a second guard part that covers the wearer's thighs above the knees. The first and the second part of the guard overlap in the joint region when the guard is straight so as to protect the wearer's knees, provided that the guard is straight or bent through a relatively small angle from a straight state. When the guard is bent to a greater extent, an opening is formed between the two mutually pivotal parts of the guard, since the extent of the overlap must be relatively small despite everything, and the overlapping parts will preferably be able to curve in the proximity of the joint. This opening between said parts on the front side of the guard is covered by a cup-shaped third part which is pivotally mounted on the guard. It is known from SE-B-8103133-8 to guide the movement of the third part (the knee part) in relation to the first and the second part of the guard by means of a joint device. One drawback, however, with this known solution is that the distance between the first and the second part on the one hand and the third part on the other hand varies to a relatively large extent in the angular range through which the guard is able to bend, this distance being greatest in the maximum bent state of the guard. Moreover, the mean distance between the overlapping parts of the first and the second parts of the guard also varies as the guard bends.

Accordingly, one object of the present invention is to provide a novel leg guard joint device of the kind indicated with which the distance of the cup-shaped third part from the first and the second part of said guard is reduced during bending movement of the guard.

A further object of the invention is to provide a better design of the guard parts that overlap mutually in the knee region and to position their centres of curvature such as to minimise the variation in the thickness of the guard in the knee region, as the guard bends between the limit positions.

These objects are achieved with the present invention.

The invention is defined in the accompanying independent claim 1.

Further embodiments of the inventive joint device will be apparent from the accompanying dependent claims.

Figure 1:
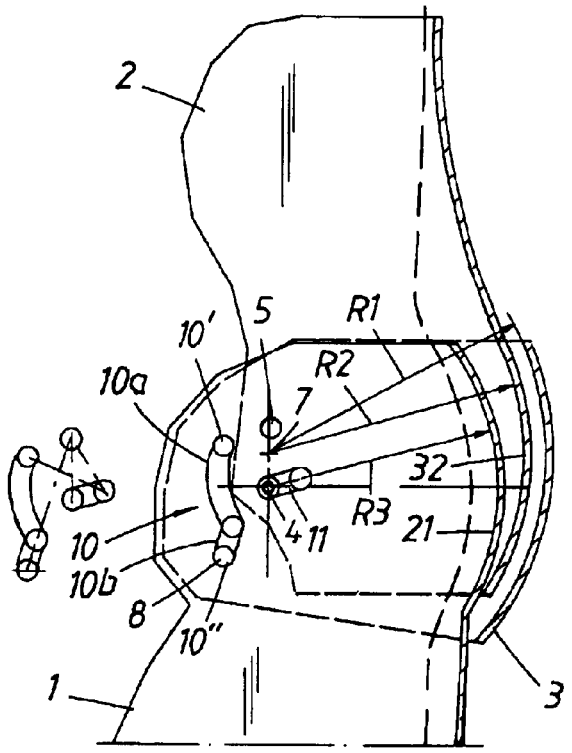
FIG. 1 is a schematic sectioned view of an inventive leg guard taken generally in a symmetry plane of the guard, and illustrates the guard in a straight state on a straight leg.

The leg guard preferably comprises a cup-shaped and anatomically configured first part 1 that is intended to protect the front side of the wearer's leg between foot and knee, and a second preferably cup-shaped and anatomically configured second part 2 that is intended to protect the front side of part of the wearer's thigh immediately above the knee, and a third cup-shaped and anatomically configured part 3 that is intended to cover an opening which forms between the overlapping portions 21, 32 of respective parts 1 and 2 when the leg guard and the leg are bent generally at an angle from the straight state of leg and guard. It will be understood that the cup-shaped parts 1–3 do not only cover the front side of the wearer's leg, but also extend inwardly over the outside and inside of the leg. The part 1 is connected pivotally to the part 2 by means of a hinge means that comprises two hinge joints which comprise two mutually facing and generally aligned swivel joints on each side of the leg guard. Each of the swivel joints includes an axial pin 4 that extends into an associated groove or slot 11 in the proximal portion of the knee part 3. The knee part 3 is pivotally connected to the part 2 by means of a swivel joint 5 on each side of the part 3, so as to enable the part 3 to swivel about an axis that is generally parallel with the pins 4. The centre of curvature of the groove or slot 11 lies in the joint 5, which is shown to lie immediately above the pin 4 when located in the lower part of the groove or slot 11. The groove or slot 11 has an upper end 11' against which respective pins 4 are in contact when the parts 1, 2 define an angle of about 130° (see FIG. 2). The part 3 will follow the part 2 when the angle between the parts 1, 2 then decreases as the leg guard is bent more significantly.

The sides of the part 1 carry a pair of pins 8, which face towards one another and engage in a respective slot 10 in the part 3. The slot 10 has an upper part 10*a* that has a circular curvature with a centre of curvature in the position taken by the joint 4 when in abutment with the upper end 11' of the slot or groove 11. When the leg guard is bent more pronouncedly, i.e. when the parts 1, 2 mutually define an angle which is smaller than about 130° (the pin 8 will come into abutment with the upper end 10' of the slot 10 when the angle is about 60°), the pin 8 is able to move freely along the portion 10*a* of the slot 10.

The slot 10 also includes a bottom part that extends from the lower end of the upper curved slot portion 10*a* and continues radially outwards in a straight path from the joint 5 such as to guide pivotal movement of the part 3 about said joint 5, whereas the parts 1, 2 define angles in the range of 130–180°. The lower end 10*b* of the slot portion 10*a* defines a pivotal end position downwardly of the part 3. The extension of the slot portion 10*b* promotes parallel displacement of the part 3 in relation to the overlapping portions 21, 32 of the parts 1, 2 and pivotal movement of the part 3 relative to the portions 21, 32. Thus, when the leg guard is bent from the limit angle, about 130°, to a straight state, the part 3 will be displaced generally in parallel away from the parts 1, 2 in the symmetry plane of the leg guard and the part 3 will, at the same time, be moved downwards in relation to the portion 32 and upwards in relation to the portion 21.

It will be seen from FIG. 1 that the portion 32 and the front portion of the part 3 have a common centre of curvature 7 when the leg guard is straight, wherewith the radii r1, r2 are about 10 cm and the distance between the parts is about 5 mm. The centre of curvature 7 lies generally midway of the joints 4, 5 in FIG. 1. The portion 21 has a radius of curvature r3 in the order of about 8.5 cm and has its centre in the joint 4 in the state shown in FIG. 1, wherewith the edge of the front portion of the part 3 lies closely adjacent to the front side of the part 1.

Figure 2:
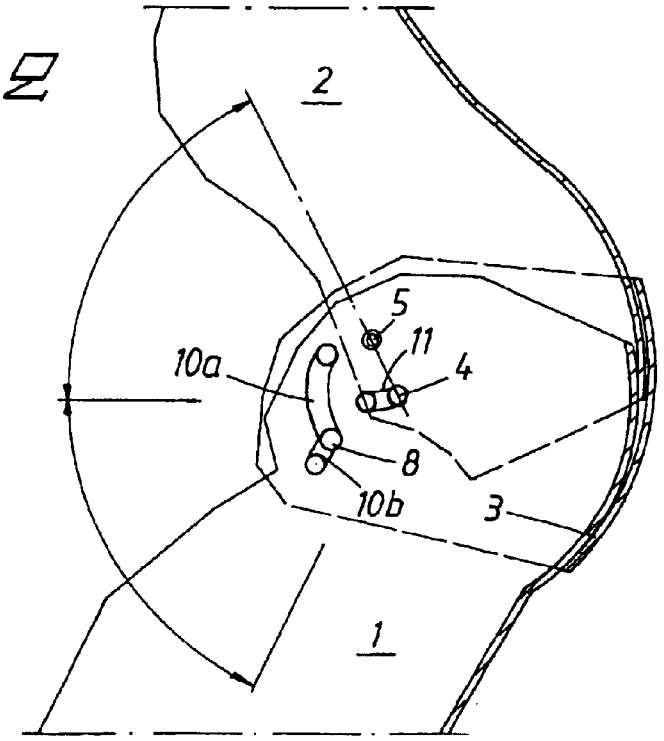
FIG. 2 shows the leg guard in a partially bent state.
Figure 3:
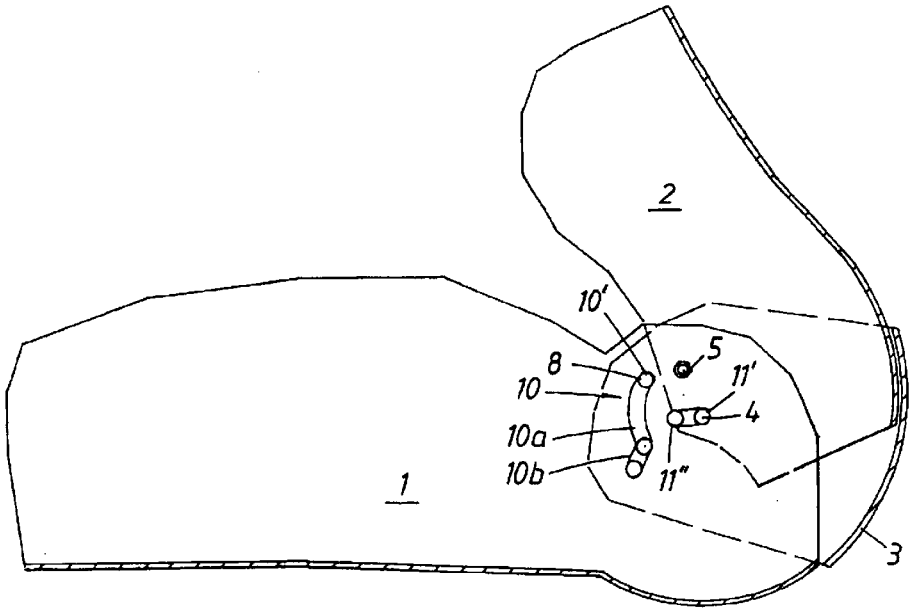
FIG. 3 shows the leg guard in a maximum bent state.

It will be seen from FIGS. 2 and 3 that the parts 1, 2 and 3 lie radially close to one another and have generally the same radius around the joint 4 when said joint lies at the end 11' of the slot 11, i.e. in the angular range of 60–130° of said guard, so that the guard will obtain a generally smooth surface contour in the angular range of 60–130° without the occurrence of any significant gap between the upper and lower edges of the part 3 and the underlying portion of respective parts 32 and 21.

The design of the lower portion 10*b* of the slot 10 means that pivotal movement of the part 3 will be controlled so as to prevent the front region of the part 3 interfering with the front of the part 1 on the one hand and is essentially displaced in parallel on the other hand when the leg guard is straightened from the limit angle (about 130°) to a fully straight state (180°).

What is claimed is:

1. A leg guard joint device that includes a first part (1) which has a U-shaped cross-section and that is intended to extend in the form of a protective cup along the front side of the lower leg of the wearer, a second part (2) that has the form of a cup of U-shaped cross-section and that is intended to extend along the front side of the wearer's thigh, wherein the first and the second part overlap mutually at least to some extent and are pivotally joined together by means of a first joint element, wherein a third cup-shaped part (3) overlaps the first and the second parts and is intended to protect the wearer's knee, wherein the first joint element includes two first swivel joints arranged on respective sides of the leg guard and extending generally co-axially with each other, wherein the third part (3) is pivotally joined to the second part (2) by means of a second joint element that includes two generally co-axial second joint elements (5) on respective sides of the leg guard, said second joint elements being spaced from the first joint element (4), wherein two mutually facing guide pins (8) on the opposing sides of the first part (1) are arranged to run along a respective first slot (10*a*, 10*b*) in the cup-shaped part, and wherein the first joint elements in pins (4) whose ends are arranged to run in second slots (11) in the cup-shaped part (3), wherein the second slots (11) are circular and have their centre of curvature in the second joint elements (5), wherein the second slots (11) have an end (11') which co-acts with the pins (4) from a predetermined intermediate limit angle for the relative pivotal movements of the parts (1, 2), so that the third part (3) will be dogged by the second part (2) when the angle between the first and the second parts (1, 2) is smaller than the limit angle, characterised in that the first slots (10*a*, 10*b*) have a circular curved section (10*a*) whose centre of curvature lies in the first joint elements (4) when said first and said second parts (1, 2) define an angle which is smaller than the limit angle; and in that the slot (10*a*, 10*b*) has a section (10*b*) which connects with the curve section (10*a*) and which extends generally radially to the joint elements (5) away from that end of the curve section (10*a*) that lies distal from the second joint elements (5) when the pivotal position of the first and the second parts (1, 2) lies between the limit angle and a maximum angle.

2. A joint device according to claim 1, characterised in that the third part (3) and the first part (1) overlap each other with a small distance and have essentially the same radius of curvature and the same centre of curvature in respect of their relative pivotal movement in the pivotal range beneath the limit angle.

3. A joint device according to claim 1, characterised in that the third part (3) and the portion (32) of the second part (32) overlapped by said third part have a generally constant mutual distance along the curved front portion of said third part at a maximum angle between the first and the second parts (1, 2).

* * * * *